US007516789B2

(12) United States Patent
Chhina et al.

(10) Patent No.: US 7,516,789 B2
(45) Date of Patent: Apr. 14, 2009

(54) HYDROCARBON RECOVERY FACILITATED BY IN SITU COMBUSTION UTILIZING HORIZONTAL WELL PAIRS

(75) Inventors: Harbir S. Chhina, Calgary (CA); Ben Nzekwu, Calgary (CA)

(73) Assignee: EnCana Corporation, Alberta (CA)

( * ) Notice: Subject to any disclaimer, the term of this patent is extended or adjusted under 35 U.S.C. 154(b) by 0 days.

(21) Appl. No.: 11/813,842

(22) PCT Filed: Jan. 13, 2006

(86) PCT No.: PCT/CA2006/000047

§ 371 (c)(1),
(2), (4) Date: Jan. 30, 2008

(87) PCT Pub. No.: WO2006/074555

PCT Pub. Date: Jul. 20, 2006

(65) Prior Publication Data

US 2008/0264635 A1 Oct. 30, 2008

(30) Foreign Application Priority Data

Jan. 13, 2005 (CA) ..... 2492306

(51) Int. Cl.
*E21B 43/243* (2006.01)

(52) U.S. Cl. ..... 166/260; 166/245; 166/272.7

(58) Field of Classification Search ..... None
See application file for complete search history.

(56) References Cited

U.S. PATENT DOCUMENTS

| | | | | |
|---|---|---|---|---|
| 5,211,230 | A | 5/1993 | Ostapovitch et al. | |
| 5,339,897 | A | 8/1994 | Leaute | |
| 5,456,315 | A * | 10/1995 | Kisman et al. | 166/245 |
| 2008/0169096 | A1 * | 7/2008 | Ayasse | 166/261 |

* cited by examiner

*Primary Examiner*—Zakiya W. Bates
(74) *Attorney, Agent, or Firm*—Karl Bozicevic; Bozicevic, Field & Francis LLP

(57) ABSTRACT

The invention provides hydrocarbon recovery processes that may be utilized in heavy oil reservoirs. Horizontal hydrocarbon production wells may be provided below horizontal oxidizing gas injection wells, with distant combustion gas production wells offset from the injection well by a distance that is greater than the hydrocarbon production well offset distance. Oxidizing gases injected into the reservoir through the injection well support in situ combustion, to mobilize hydrocarbons. The process may be adapted for use in a reservoir that has undergone depletion of petroleum in a precedential petroleum recovery process, such as a steam-assisted-gravity-drainage process, leaving a residual oil deposit in the reservoir as well as mobile zone chambers. Processes of the invention may be modulated so that a portion of the residual oil supports in situ combustion, while a larger portion of the residual oil is produced, by channelling combustion gases along the pre-existing mobile zones with the reservoir.

20 Claims, 13 Drawing Sheets

HYDROCARBON RECOVERY FACILITATED BY IN SITU COMBUSTION UTILIZING HORIZONTAL WELL PAIRS

FIELD OF THE INVENTION

The present invention relates generally to oil recovery processes, particularly thermal recovery processes that may be used in oil sands. In some embodiments, the processes of the invention utilize horizontal well pairs in heavy oil reservoirs, such as oil sands, to support production of hydrocarbons mobilized by in situ combustion. Aspects of the invention may for example be practiced following previous depletion of a reservoir. In particular, the invention provides a secondary recovery process that may advantageously be practiced following an initial recovery process utilizing the same horizontal well pairs.

BACKGROUND OF THE INVENTION

A variety of processes are used to recover viscous hydrocarbons, such as heavy oils and bitumen, from underground deposits. There are extensive deposits of viscous hydrocarbons around the world, including large deposits in the Northern Alberta tar sands, that are not amenable to standard oil well production technologies. The primary problem associated with producing hydrocarbons from such deposits is that the hydrocarbons are too viscous to flow at commercially relevant rates at the temperatures and pressures present in the reservoir. In some cases, such deposits are mined using open-pit mining techniques to extract the hydrocarbon-bearing material for later processing to extract the hydrocarbons. Alternatively, thermal techniques may be used to heat the reservoir to produce the heated, mobilized hydrocarbons from wells. One such technique for utilizing a single horizontal well for injecting heated fluids and producing hydrocarbons is described in U.S. Pat. No. 4,116,275, which also describes some of the problems associated with the production of mobilized viscous hydrocarbons from horizontal wells.

One thermal method of recovering viscous hydrocarbons using two vertically spaced horizontal wells is known as steam-assisted gravity drainage (SAGD). Various embodiments of the SAGD process are described in Canadian Patent No. 1,304,287 and corresponding U.S. Pat. No. 4,344,485. In the SAGD process, steam is pumped through an upper, horizontal, injection well into a viscous hydrocarbon reservoir while hydrocarbons are produced from a lower, parallel, horizontal, production well vertically spaced proximate to the injection well. The injection and production wells are typically located close to the bottom of the hydrocarbon deposit.

It is believed that the SAGD process works as follows. The injected steam initially mobilises the in-place hydrocarbon to create a "steam chamber" in the reservoir around and above the horizontal injection well. The term "steam chamber" means the volume of the reservoir which is saturated with injected steam and from which mobilised oil has at least partially drained. As the steam chamber expands upwardly and laterally from the injection well, viscous hydrocarbons in the reservoir are heated and mobilized, especially at the margins of the steam chamber where the steam condenses and heats a layer of viscous hydrocarbons by thermal conduction. The mobilized hydrocarbons (and aqueous condensate) drain under the effects of gravity towards the bottom of the steam chamber, where the production well is located. The mobilized hydrocarbons are collected and produced from the production well. The rate of steam injection and the rate of hydrocarbon production may be modulated to control the growth of the steam chamber to ensure that the production well remains located at the bottom of the steam chamber in an appropriate position to collect mobilized hydrocarbons.

Alternative primary recovery processes may be used that employ thermal and non-thermal components to mobilize oil. For example, light hydrocarbons may be used to mobilize heavy oil. U.S. Pat. No. 5,407,009 teaches an exemplary technique of injecting a hydrocarbon solvent vapour, such as ethane, propane or butane, to mobilize hydrocarbons in the reservoir.

Heavy oil recovery techniques such as SAGD create mobile zone chambers in a reservoir, from which at least some of the original oil-in-place has been recovered. However, reservoirs depleted by such processes typically contain a significant volume of residual hydrocarbons. There remains a need for methods that may be used to recover these residual hydrocarbons.

In the context of the present application, various terms are used in accordance with what is understood to be the ordinary meaning of those terms. For example, "petroleum" is a naturally occurring mixture consisting predominantly of hydrocarbons in the gaseous, liquid or solid phase. In the context of the present application, the words "petroleum" and "hydrocarbon" are used to refer to mixtures of widely varying composition. The production of petroleum from a reservoir necessarily involves the production of hydrocarbons, but is not limited to hydrocarbon production. Similarly, processes that produce hydrocarbons from a well will generally also produce petroleum fluids that are not hydrocarbons. In accordance with this usage, a process for producing petroleum or hydrocarbons is not necessarily a process that produces exclusively petroleum or hydrocarbons, respectively. "Fluids", such as petroleum fluids, include both liquids and gases.

It is common practice to segregate petroleum substances of high viscosity and density into two categories, "heavy oil" and "bitumen". For example, some sources define "heavy oil" as a petroleum that has a mass density of greater than about 900 kg/m3. Bitumen is sometimes described as that portion of petroleum that exists in the semi-solid or solid phase in natural deposits, with a mass density greater than about 1000 $kg/m^3$ and a viscosity greater than 10,000 centipoise (cP; or 10 Pa.s) measured at original temperature in the deposit and atmospheric pressure, on a gas-free basis. Although these terms are in common use, references to heavy oil and bitumen represent categories of convenience, and there is a continuum of properties between heavy oil and bitumen. Accordingly, references to heavy oil and/or bitumen herein include the continuum of such substances, and do not imply the existence of some fixed and universally recognized boundary between the two substances. In particular, the term "heavy oil" includes within its scope all "bitumen" including hydrocarbons that are present in semi-solid or solid form.

A reservoir is a subsurface formation containing one or more natural accumulations of moveable petroleum, which are generally confined by relatively impermeable rock. In a reservoir, the mobility of entrained fluids, such as petroleum, may be defined as the ratio of permeability to viscosity. The higher the permeability, all other things being equal, the higher the mobility. Correspondingly, the higher the viscosity, the lower the mobility. A "mobile zone" within a reservoir is a contiguous region characterised as having greater mobility than adjoining regions. The mobility of fluids within the mobile zone may vary, and some regions within a mobile zone may in fact exhibit less mobility than adjoining regions, while the mobile zone as a whole is nevertheless characterised as a region of relatively high mobility. Accordingly, the term "mobile zone" as used herein is a relative term, meaning that the zone referred to contains a fluid that is more mobile than fluids in adjoining zones.

An "oil sand" or "tar sand" reservoir is generally comprised of strata of sand or sandstone containing petroleum. Mobile zones may exist in oil sand or tar sand reservoirs, within or across strata, and may extend into adjoining strata.

A "chamber" within a reservoir or formation is a region that is in fluid communication with a particular well or wells, such as an injection or production well. For example, in a SAGD process, a steam chamber is the region of the reservoir in fluid communication with a steam injection well, which is also the region that is subject to depletion, primarily by gravity drainage, into a production well. In some processes, chambers that are in fluid communication with a single well may be enlarged so that they then communicate with additional wells or chambers, when this occurs it may be characterised as a "breakthrough" of fluid communication from one well to another, or a coalescence of steam chambers. In accordance with the foregoing, in the context of the present invention, a "mobile zone chamber" is a chamber that encompasses a mobile zone.

A wide variety of horizontal well drilling techniques are known. In typical horizontal wells, a single well will generally have segments that are primarily horizontal, as well as segments that are primarily vertical. In the context of the present invention, a generally horizontal well segment in a reservoir is a segment of a well that has a horizontal distance that is at least as great as its vertical distance within the hydrocarbon reservoir.

SUMMARY OF THE INVENTION

In one aspect, the invention provides a hydrocarbon (i.e. petroleum) recovery process. The process may include the step of selecting a hydrocarbon reservoir bearing a heavy oil, which may for example include, or in alternative embodiments be made up entirely of, alternative components such as bitumens, medium crudes or light crudes. The reservoir may for example include sand or sandstone strata, which may alternate with other strata, such as strata made up of carbonate materials.

A number of wells may be arranged within the reservoir, in general the wells are arranged so that at least some segments of the wells are in fluid communication with the hydrocarbon-bearing portions of the reservoir. Where a reservoir is said to include or comprise a well, it is meant that at least a portion of the well or well segment is in fluid communication with the reservoir. In some embodiments, the well formation may be the result of previous recovery operations, such as SAGD processes for heavy oil and bitumen reservoirs, or primary production for light and medium oil reservoirs.

The reservoir may include a generally horizontal segment of a hydrocarbon production well. By "generally horizontal", it is meant that the well segment may deviate significantly from horizontal. In addition, the well may of course include other segments that are not horizontal. The reservoir may also include a generally horizontal segment of an oxidizing gas injection well. This portion of the oxidizing gas injection well may be generally parallel to and vertically spaced apart above the horizontal segment of the hydrocarbon production well. This is, for example, a common arrangement for a horizontal well pair that is used in SAGD processes, with the upper-most well used for steam injection and the lower-most well used for production of mobilized oil. For the purpose of defining the spatial relationship of wells in the reservoir, the average distance between the horizontal segments of the oxidizing gas injection well and the hydrocarbon production well may be designated as providing a "hydrocarbon production well offset distance".

The reservoir may also include a generally horizontal segment of a combustion gas production well. This segment of the combustion gas production well may be generally parallel to and horizontally spaced apart laterally from the horizontal segment of the oxidizing gas injection well. In some embodiments, for example utilising the horizontal well pair arrangement comprising the SAGD steam chambers, the process of the invention may make use of a generally horizontal segment of a second hydrocarbon production well. This second production well segment may be generally parallel to and vertically spaced apart below the horizontal segment of the combustion gas production well.

Again, for the purpose of defining the spatial relationship of the wells in the formation, the average distance between the horizontal segments of the oxidizing gas injection well and the combustion gas production well may be designated as providing a "combustion gas production well offset distance". In some embodiments, the combustion gas production well offset distance is greater than the hydrocarbon production well offset distance. This spatial relationship creates a particular challenge, which is to direct oxidizing gases injected into the formation along the horizontal segment of the oxidizing gas injection well vertically upwards towards and towards the combustion gas production well rather than vertically downwards and towards the hydrocarbon production well. Because of the forgoing spatial relationship, this will involve modulating conditions within the reservoir so that the combustion gases traverse the longer combustion well offset distance rather than the shorter hydrocarbon production well offset distance. This patter of combustion gas flow may be facilitated by the presence of one or more mobile zones in the reservoir that at least in part span the combustion well offset distance. In some embodiments, such zones may be formed by coalescing or communicating steam chambers.

For the purposes of the foregoing discussion, and for clarity in the claims, wells have been identified by an intended function. This does not, however, imply that the wells are reserved exclusively for any particular purpose. For example, a combustion gas production well need not be reserved exclusively for this purpose, although it may be adapted for it with appropriate completions.

In some embodiments, the processes of the invention may involve injecting an oxidizing gas, such as air, enriched air, diluted air or another gas containing oxygen, into the formation, for example through the oxidizing gas injection well, to support in situ combustion in the formation. The in situ combustion may then be managed so as to mobilize hydrocarbons in the heavy oil. Fluids may be produced from the combustion gas production well, for example in a manner that directs combustion gases to the combustion gas production well. Mobilized hydrocarbons may be recovered from the formation through the hydrocarbon production well, for example by pumping fluids to the surface of the well. Fluids produced from a hydrocarbon production well may, from time to time, include a significant proportion of combustion gases. In some embodiments, the invention accordingly contemplates steps to control fluid flow within the reservoir to adjust the pressure, temperature and nature of produced and injected fluids, so as to achieve, on occasion, the production of hydrocarbons from production wells and the injection of oxidizing gases at injection wells. In some embodiments, the production rates of fluids such as water and oil may be controlled, and the injection rates of oxidising gases controlled, to optimise oil production without excessive combustion gases, i.e. to avoid bypass of oxidising or combustion gases into the hydrocarbon production well.

In some embodiments, oxygen injection rates may be modulated so that combustion takes place in a high temperature regime in the reservoir, and so as to prevent the formation of low temperature oxidation products. The presence of low temperature oxidation products may thereby be avoided in produced hydrocarbons. In some embodiments, a minimum temperature threshold that is desired in the reservoir in situ combustion region, to reduce low temperature oxidation, may be established. A minimum temperature threshold may for example be determined from laboratory combustion tube experiments. In alternative embodiments, the minimum temperature threshold may vary with the type of oil that fuels in situ combustion, for example being generally lower for light oils and higher for heavy oils and bitumens. In some embodiments, where the reservoir comprises heavy oils or bitumens, the low temperature threshold may for example be approximately 400 degrees C.

In alternative embodiments, in situ combustion may be modulated so as to achieve a desired ratio of the volume of air required to recover a certain volume of oil. For example, in some embodiments, the processes of the invention may be carried out so that this ratio is no more than about 1000 scf of air per barrel of oil produced (the air-oil-ratio or AOR). In alternative embodiments, this ratio may be derived from a variety of laboratory combustion tube experiments using specific oil and reservoir rock samples from the reservoir.

In some embodiments, prior to the hydrocarbon recovery processes of the invention, the formation, or a portion thereof, may have undergone depletion of petroleum in a precedent petroleum recovery process. For example, the precedent petroleum recovery process may involve producing petroleum from the hydrocarbon production well, it may also involve injecting a mobilizing fluid into the injection well to mobilize the petroleum. In some processes that may be used for this purpose, such as SAGD, gravity provides a force that acts to direct the mobilized petroleum downward to hydrocarbon production well. In alternative embodiments, the mobilizing fluid may for example be steam, hot water, methane, hydrocarbon solvents or combinations thereof.

In some embodiments, in situ combustion may be initiated in a distinct process in the context of the hydrocarbon recovery processes of the invention. In further alternative embodiments, in situ combustion may be controlled by injecting an aqueous fluid through the injection well.

In particular embodiments, the processes of this invention may be preceded by a pre-conditioning step. The pre-conditioning step may for example be carried out so as to improve the fluid communication between chambers within the reservoir, for example between steam chambers. This may for example be useful in situations where such communication does not exist in the reservoir, or where there is a need to extend the region of fluid communication along the length of the span between adjacent well pairs, for example between adjacent steam chambers that are present following a SADG recovery process. In some embodiments, establishing or extending fluid communication across the span between adjacent well pairs early in the process of the invention may be desirable to prevent over-pressuring the reservoir during in situ combustion. In such embodiments, a first well-pair may comprise an overlying oxidising gas injection well and an underlying hydrocarbon production well, as described elsewhere herein. In the pre-conditioning step, an oxygen containing gas is injected into the overlying injection well while hydrocarbon fluids are produced simultaneously from the horizontal production well of the pair.

In some embodiments, the rate of oxidising gas injection in a pre-conditioning step may be largely determined by the extent of hydrocarbon depletion in the mobile zone chamber that is in fluid communication with the oxidising gas injection well. The rate of oxidising gas injection may be adjusted so that it is sufficient to initiate and maintain relatively high temperature in situ combustion, while maintaining a pre-conditioning mobile zone chamber pressure that facilitates production of hydrocarbon fluids from the underlying hydrocarbon production well. In the pre-conditioning phase, operational oxidising gas injection rates may for example be lower than the rate of oxidising gas injection required for a subsequent in situ hydrocarbon displacement processes involving fluid communication between the oxidising gas injection well and the distant combustion gas production well. For example, in some embodiments, the pre-conditioning oxidising gas injection rate may be as low as one-tenth of the rate of oxidising gas injection in a subsequent hydrocarbon recovery process.

In the pre-conditioning phase, following initiation of oxidising gas injection, and ignition of in situ combustion, the rate of continued injection of the oxidising gas may be adjusted to sustain an ongoing in situ combustion process. Residual oil left within the pores of the formation, for example following a precedent petroleum recovery process, may serve as a fuel for the in situ combustion process. Alternatively, fuel for in situ combustion may be introduced into the reservoir. For example, a hydrocarbon fuel may be injected through an oxidising gas injection well (typically in the absence of an oxidising gas). The gases formed as by-products of combustion, such as steam and carbon oxides, may eventually flow through from the region around the oxidising gas injection well, upwardly towards the top of the reservoir, then sideways towards the lateral edges of the mobile zone chamber in communication with the oxidising gas injection well, and then downwardly to the combustion gas production well. As the fluid flow motivated by the combustion gases traces this path, the gases may sweep out or mobilise oil along the combustion gas flow path, displacing hydrocarbons in the reservoir for production at the hydrocarbon production well.

Continued oxidising gas injection in the pre-conditioning process may be modulated so that the combustion front proceeds with a significant vertically upward component, as injected oxygen reacts with the residual oil in the chamber. The heat generated by in situ combustion may be transmitted by conduction through the rock matrix and by convection through the flow of the combustion gases and steam, effecting mobilisation of residual oil. In some embodiments, the rate of oxidising gas injection may accordingly be modulated to adjust the shape and extent of the reservoir region swept out (depleted) by the combustion gases. Similarly, the rate of oxidising gas injection may be modulated to adjust the peak temperature of the in situ combustion front. In general, the higher the rate of oxidising gas injection, the higher the combustion front temperature. In some embodiments, the rate of oxidising gas injection may be maintained so that temperatures at the in situ combustion front are in the range of 350 to 450° C., i.e. around 400° C.

The movement of the combustion front, or adjacent combustion fronts in adjacent chambers, towards the top of the reservoir in the pre-conditioning phase may be adjusted so that heat transfer creates a more uniform communication zone between pre-existing adjacent steam chambers, or mobile zone chambers, for example to establish fluid communication between adjacent mobile zone chambers where such communication did not exist at the onset of pre-conditioning. At the conclusion of the pre-conditioning phase of the hydrocarbon recovery process, adjacent parallel spaced apart horizontal wells may be converted so that alternating oxidising gas injection wells operated during pre-conditioning are converted to combustion gas production wells.

In some embodiments, such as embodiments carried out following the foregoing pre-conditioning steps, the process of the invention may make use of a generally horizontal segment of a second hydrocarbon production well. This second production well segment may be generally parallel to and vertically spaced apart below the horizontal segment of the combustion gas production well. In such embodiments, the average distance between the horizontal segments of the second hydrocarbon production well and the combustion gas production well may be defined as providing a "second hydrocarbon production well offset distance". The combustion gas production well offset distance may, in some cases, be greater than the second hydrocarbon production well offset distance. In such an arrangement of wells, mobilized hydrocarbons may be recovered from both the hydrocarbon production well and the second hydrocarbon production well.

To define the arrangement of wells in terms of well pairs, the oxidizing gas injection well and the hydrocarbon production well may be taken to form a first well pair. A second well pair may be formed by a second oxidizing gas injection well and a second hydrocarbon production well. The second oxidizing gas injection well may for example have a generally horizontal segment in fluid communication with the reservoir that is generally parallel to and vertically spaced apart above a generally horizontal segment of the second hydrocarbon production well. The generally horizontal segments of the second well pair may be generally parallel to and horizontally spaced apart laterally from the horizontal segments of the first well pair. The combustion gas production well may be located between these first and second well pairs.

It will be appreciated from the foregoing that a field may comprise an alternating parallel arrangement of well pairs, in which oxidizing gas injection wells alternate with combustion gas production wells. So that, in such an arrangement, a particular well pair may constitute the first well pair with respect to one combustion gas production well while it also constitute the second well pair with respect to the adjoining combustion gas production well.

BRIEF DESCRIPTION OF THE FIGURES

FIG. 2A illustrates oil saturation within the reservoir under initial conditions, before recovery of oil by an initial steam-based recovery process, such as SAGD. FIG. 2B illustrates the gas mole fraction of the water phase, which is indicative of steam saturation distribution, at the end of the precedent or steam-based recovery process. The condition of the reservoir illustrated in FIG. 2B is therefore representative of reservoir conditions that may be selected as the initial condition for a follow-up in situ combustion process of the invention.

FIG. 3A shows the temperature profile in the three adjacent steam chambers at the termination of a SAGD operations. FIG. 3B shows the temperature distribution during ignition and initiation of in situ combustion at the central oxidizing gas injection well. FIG. 3C shows the combustion front rising towards the top of the central reservoir, with continued injection of oxidizing gas (air), peak temperatures as illustrated may be as high as 600° C to 700° C. FIG. 3D shows the combustion front reaching the top of the central reservoir and spreading laterally into adjacent reservoir chambers.

FIG. 4A illustrates a large "hump" of remaining or residual oil between adjacent steam chambers. FIG. 4B illustrates the changing oil saturation profile as the remaining oil between the chambers is mobilized by in situ combustion, which has the putative combined effect of causing heating, gravity drainage, enhanced steam drive and gas drive. FIG. 4C shows a further reduction in remaining oil between steam chambers as in situ combustion progresses. FIG. 4D illustrates the oil saturation distribution as the in situ combustion process of the invention approaches relatively late stages of recovery, showing that a considerable portion of the remaining oil has been mobilized and produced.

FIG. 5A shows the water phase gas mole fraction distribution that is indicative of steam saturation distribution at the end of a precedent or steam-based recovery process (SAGD). FIG. 5B shows rearrangement of the gas mole fraction (water) distribution following initiation of air injection and combustion at the oxidizing gas injector well of a central well pair. FIG. 5C shows the gradient of gas mole fraction water, as in situ combustion reactions generate heat to enhance steam bank growth. FIG. 5D illustrates enhanced steam bank distribution, showing heat transfer to mobilize remaining oil.

FIG. 6A illustrates a pattern of oxygen distribution that is indicative of the region swept by the combustion front as the oxidizing gas supports combustion of residual oil. FIG. 6B shows the continued spread of oxygen as an indication of the growth of the zone swept by the combustion front. FIG. 6C illustrates the pattern of gas mole fractions of oxygen that show growth of a combustion-swept zone into adjacent chambers, a chamber being the area drained by a particular hydrocarbon production well. FIG. 6*d* shows the late stages of the gas mole fraction (oxygen) profile. In the illustrated embodiment, the process is terminated at a time before unused oxygen gas can breakthrough to the gas production well.

DETAILED DESCRIPTION OF THE INVENTION

Figure 9:
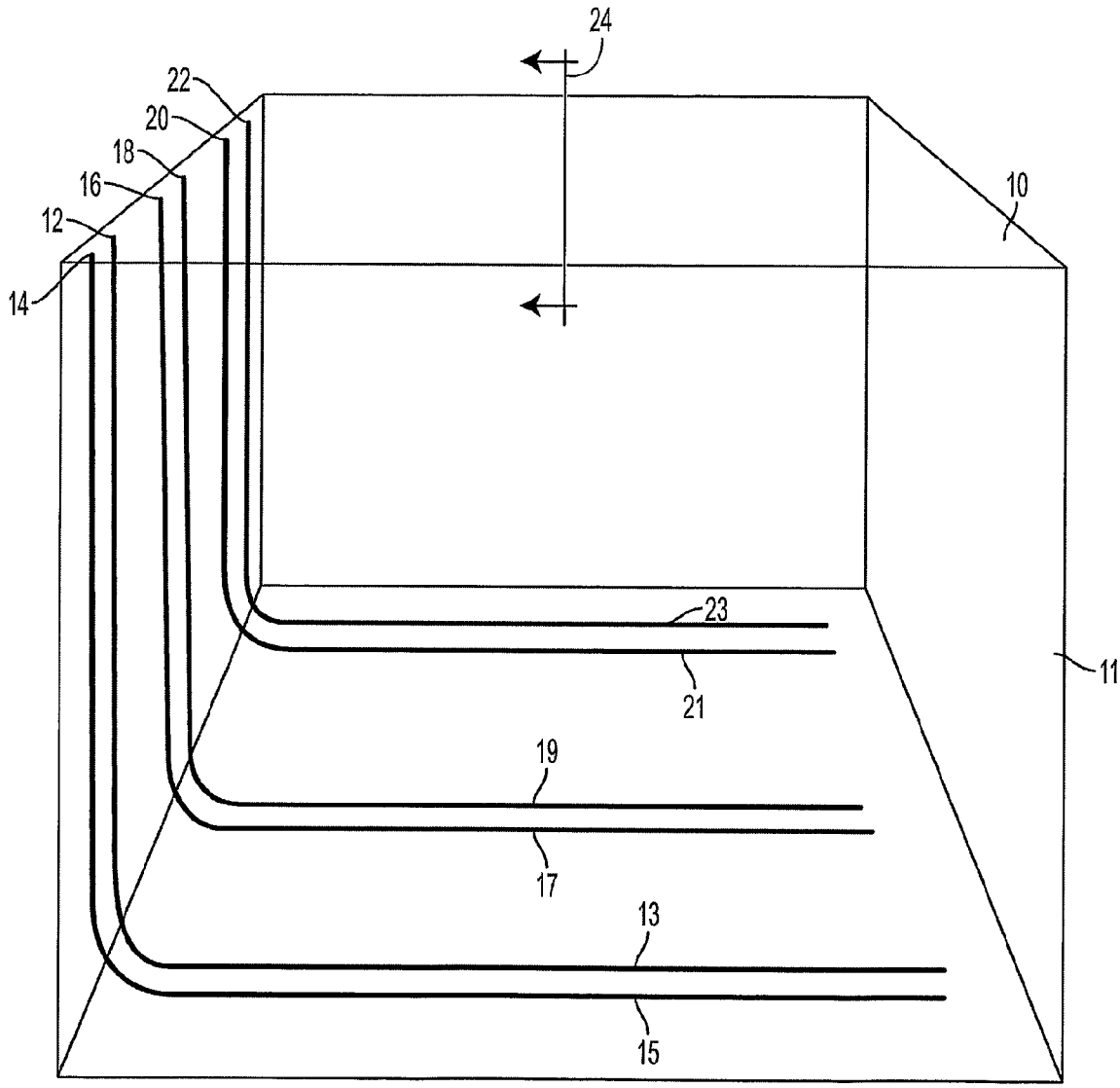
FIG. 9 is an isometric view showing a pattern of longitudinal well pairs spaced apart laterally at the base of a reservoir, illustrating a confirmation of wells that may be adapted for use in the invention.

In some embodiments, the process of the invention may be carried out following a previous petroleum recovery processes, for example a process that employs horizontal well pairs in a conformation that is suited to the processes of the present invention (as illustrated in FIG. 9). For example, a SAGD process may employ the upper horizontal well of a pair 19 as the injection well and the lower horizontal well of the pair 17 may function as the hydrocarbon production well (in a process and well configuration as for example is described in U.S. Pat. No. 4,344,485, incorporated herein by reference). A series of such well pairs may for example be emplaced in parallel laterally spaced apart in a reservoir, as shown in FIG. 9.

The previous petroleum recovery processes may for include alternative processes utilizing both steam and additional components, such as light hydrocarbon solvents, or may include processes which utilise light hydrocarbon solvents alone. A variety of alternative recovery processes are for example described in U.S. Pat. Nos. 6,932,168; 6,883,607; 6,769,486; 6,729,394; 6,662,872; 6,263,965; 6,230,814; 6,050,335; 5,931,230; 5,899,274; 5,860,475; 5,803,171; 5,626,193; 5,607,016; 5,503,226; 5,417,283; 5,407,009; 5,273,111; 5,215,146; 5,060,726; 5,042,579; 4,577,691; 4,511,000; 4,501,326; 4,460,044 (all of which are incorporated herein by reference).

In some embodiments, processes of the invention involve injection of a gas with oxidizing capability (an "oxidizing gas") into an oil reservoir. The oxidizing gas may be any gas or mixture of gases that support combustion, for example air. The oxidizing gas may be ignited either through introduction of a source of ignition at the injection well, or by means of high temperatures within the oil reservoir. In some embodiments, residual oil left in place by a previous petroleum recovery process may provide the fuel for the in situ combustion process of the invention. Accordingly, in some embodiments the invention provides processes in which in situ combustion within the reservoir may be sustained by combustion of a portion of the residual oil, while the pattern of in situ combustion is managed so as to produce a portion of the residual oil.

Figure 1:
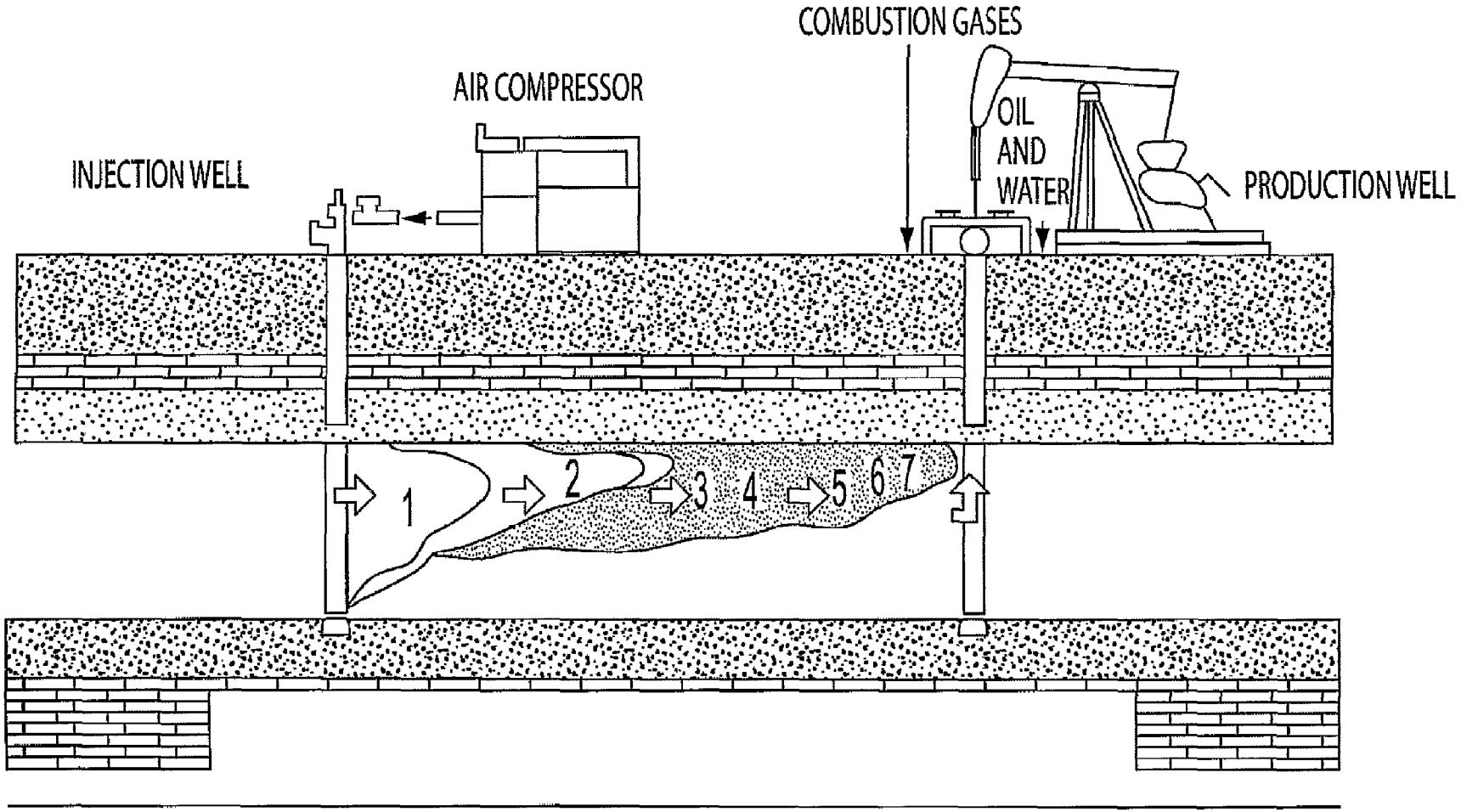
FIG. 1 illustrates a typical in situ combustion profile showing fluid and displacement zones related to the combustion fronts. The Figure illustrates a potential problem addressed by the present invention, particularly when applied to heavy oils and bitumen reservoirs. The potential problem is that the reservoir fluid regions ahead of the fluid displacement fronts have higher densities than the displacing fluids, because the residual reservoir fluids are typically relatively cold and immobile. This may create an unfavourable difference in the mobility of fluids heated by in situ combustion, the mobilised fluids, compared to the residual reservoir fluids that have not yet been mobilised, a mobility ratio, which may cause the mobilised fluids to ride up and over the residual unmobilized fluids, a circumstance that may be called gravity override, which may lead to inefficient displacement of the unmobilized fluids.
Figure 2A:
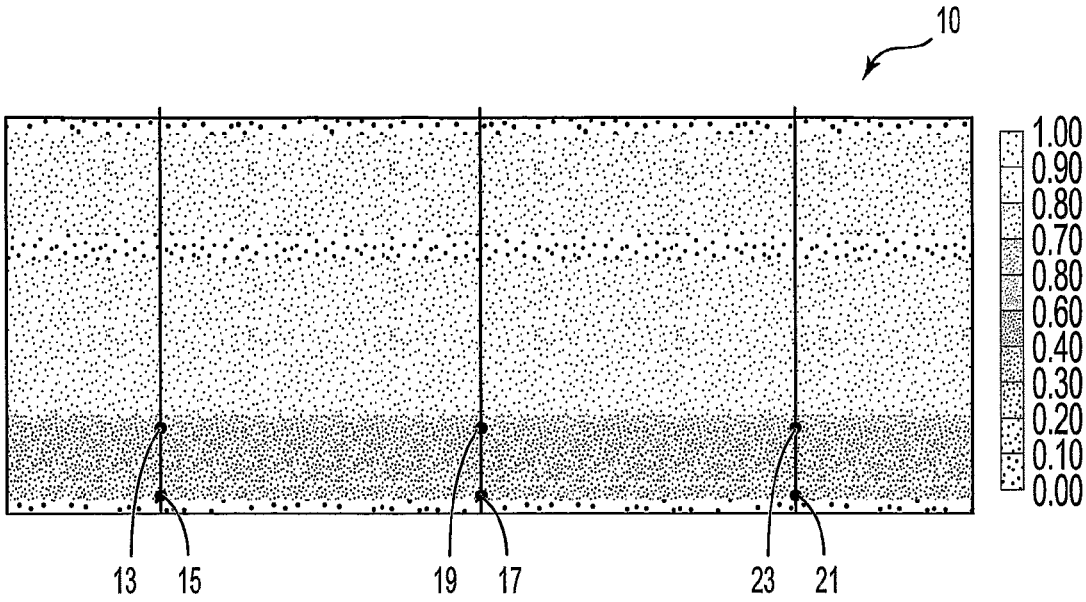
FIGS. 2A and 2B are graphic representations of a transverse vertical cross section through three parallel chambers in a heavy oil reservoir, with a well pair at the base of each chamber. The central well pair comprises an oxidizing gas injection well, generally parallel to and vertically spaced apart above a horizontal segment of a hydrocarbon production well. On either side of the central well pair, horizontally spaced apart laterally from the oxidizing gas injection well, there are two well pairs, each of which comprises a combustion gas production well above an additional hydrocarbon production well.
Figure 2B:
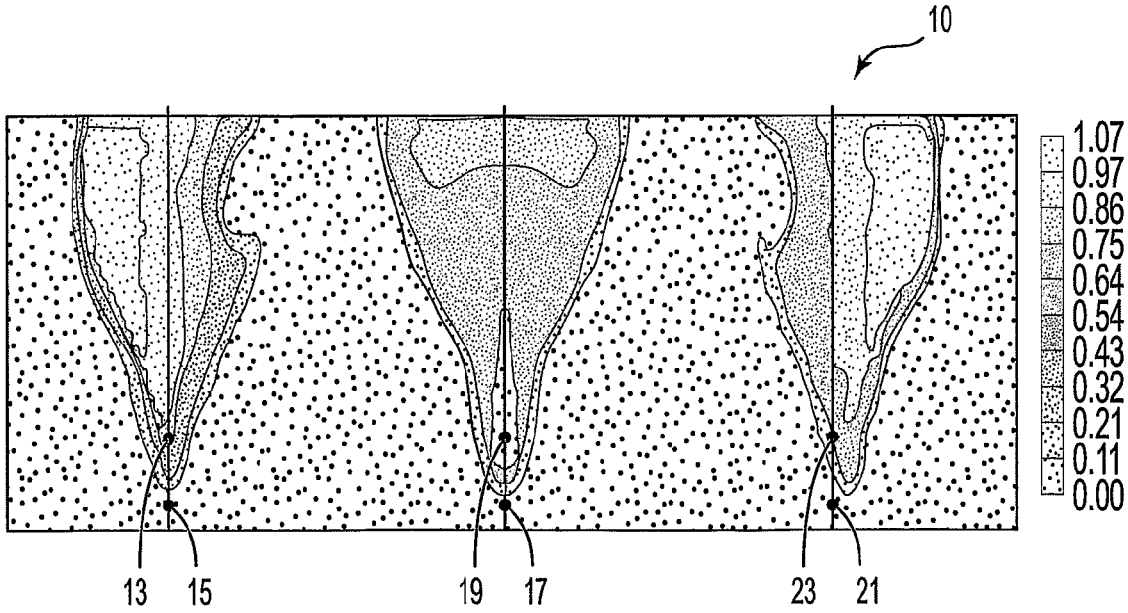

To illustrate an exemplary embodiment of the invention, FIG. 2*a* shows a model cross-section through three pairs of horizontal wells located in an oil sand or heavy oil reservoir, such as a transverse cross section looking in the direction of arrow 24 through the reservoir 11 shown in FIG. 9. In the model of FIGS. 2 through 6, each well pair has been used for a previous petroleum recovery process, such as SAGD, in which each well pair (12/14, 16/18 and 20/22) includes of an overlying horizontal injection well segment (13, 19 and 23) and an underlying horizontal production well segment (15, 17, 21). The horizontal segments of each well pair are situated towards the base of the reservoir 11. FIG. 2 illustrates a reservoir in which the precedent SAGD petroleum recovery process has been operated at these three well pairs for some period of time. As a result of the precedent recovery process, each well pair is in fluid communication with a heated mobile zone chamber that has developed over the course of time during operation of the precedent recovery process. The heated fluids that define each mobile zone chamber occupy pore space vacated by mobilized oil that has drained downward under the influence of gravity to the underlying production well, lighter steam vapor moving upward and heavier mobilized oil and condensed steam moving downward. These heated chambers have enlarged upwardly and outwardly over time, and at the illustrated time have reached a position close to the top of the reservoir.

As the mobile zone chambers enlarge laterally, particularly near the top of the reservoir, adjacent chambers may join together in fluid communication in the upper reaches of the reservoir, so that the adjacent chambers merge with each other. These precedent conditions may be well suited for the practice of various embodiments of the present invention. In some embodiments of the invention, under the precedential conditions described above, in situ combustion may be initiated in a centrally located mobile zone chamber, and the mobility of the adjoining zone utilized to produce residual oil from the space between well pairs.

FIGS. 3 to 6 illustrate the distribution of temperature, oil saturation, gas mole fraction (water) and gas mole fraction (oxygen) in contour plots derived from a numerical simulation of a process of the invention. The central overlying well 19, which had served as a steam injection well during the precedent recovery process, is adapted to become an oxidizing gas injection. Former steam injection wells 13, 23 adjacent the central steam injection well 19, are converted into combustion gas production wells. Former production wells 15, 17, 21, continue to function in this capacity. It is an aspect of some embodiments of the invention that the in situ combustion process is managed so that the combustion gases are directed from the region of the oxidizing gas injection well 19 to the distant combustion gas production wells 13, 23, while minimizing the production of combustion gases from the hydrocarbon production well 17 that is adjacent to the oxidizing gas injection well 19, utilizing the mobile zones in the reservoir to facilitate these patterns of fluid flow.

Continued injection of the oxidizing gas sustains the supply of an oxidant to support ongoing in situ combustion of residual oil left within the pores of the formation following the precedent recovery process, so that the residual oil serves as a fuel for the in situ combustion process. In alternative embodiments, additional fuel may be injected into the reservoir. The processes of the invention may be carried out so that gases formed as by-products of in situ combustion flow from the region around the oxidizing gas injection well 19 to the adjacent combustion gas production wells 13, 23, along communicating mobile zone chambers.

Heat generated as a result of in situ combustion is conveyed by conduction through the rock matrix, and by convection through the combustion gases and by steam. The steam may comprise steam that was originally resident in the heated mobile zone chambers at the outset of the in situ combustion process, heated further by the in situ combustion process. Alternatively, steam may be formed by in situ combustion heating of water that is resident in the reservoir (including water that has been injected into the reservoir or water formed within the reservoir through chemical reactions). Steam may of course be generated through a combination of these mechanisms. The combustion gases, along with the steam, mobilize residual oil that has not been depleted by the precedent recovery process, allowing the mobilized oil to move downward to the production wells in a gravity-controlled front. Thus, in some embodiments, oil is mobilized both directly through the heat contained in the combustion gases and by means of steam generated or re-generated when in situ combustion heats the water or existing steam within the oil reservoir.

In various embodiments, oil production is sustained by a combination of gravity drainage, hot gas drive and enhanced steam drive within and beyond the heated mobile zone chambers created by the precedent recovery process. Movement of the combustion front may be controlled in part by gravity. Accordingly, the process of the invention may be controlled so that the flow of combustion gases will be directed away from the oxidizing gas injection well 19 and towards the laterally offset combustion gas production wells 13, 23. In some embodiments, the process may be controlled so that combustion gases take a circuitous path, rising towards the top of the reservoir 10, moving across from the central heated mobile zone chamber to the adjoining mobile zone chambers near the top of the reservoir (where mobility may be highest), and then moving downward to the combustion gas production wells 13, 23. The flow of heated oil may include a prominent vertically downward component due to gravity effects. The process of the invention thereby provides for a flow of heating oil along paths that are generally distinct from those of the combustion gases, to facilitate separation of oil production from gas production.

In various processes of the invention, the pattern of mobilized oil flow, and combustion gas flow, allows oil to be produced from a production well 17 that is parallel to and beneath the oxidizing gas injection well 19, while combustion gases are produced from a parallel combustion gas production well 13 or 23, that is horizontally spaced apart from the injection well 19 by a distance that is greater than the distance between the injection well 19 and the hydrocarbon production well 17.

The Figures illustrate embodiments in which there are three well pairs (12/14, 16/18, and 20/22). However, processes of the invention may of course involve more or fewer well pairs. For example, if there are two well pairs, then of the two overlying wells that had served as injection wells during the precedent recovery process, one can be converted to an oxidizing gas injection well and the offsetting well may function as a combustion gas production well. The two underlying wells may then be used as hydrocarbon production wells.

If more than three well pairs are employed for purposes of the invention, then various configurations of overlying oxidizing gas injection wells and combustion gas production wells are possible. In each instance, the process may be initiated from the oxidizing gas injection well in one mobile zone chamber and the upper well in the adjacent chamber may serve as a combustion gas production well. Oil production may then occur from the lower production wells in each mobile zone chamber. With the oil production wells spaced apart from the injection well by a distance that is less than the distance between the injection well and the horizontally spaced apart combustion gas production well.

Embodiments of the invention may utilize a well pattern that results from primary production, for example a well pattern adapted for SAGD. However, if additional wells can of course be drilled to facilitate secondary recovery processes of the invention. Additional wells may for example function to mitigate the combustion gas production load that would have otherwise been assumed by the underlying production well.

In some embodiments, dry combustion may be the mode of in situ combustion. In some circumstances, it may however be advisable to control temperature within the in situ combustion zone, particularly in the immediate vicinity of the injection well, by injecting an aqueous fluid such as water to modulate combustion.

As illustrated in the Figures, the production well may underlie the injection well directly. In alternative embodiments, the production well may of course underlie the injection well in an offset manner that is not directly vertical.

In various embodiments, the position of the interface between mobilised fluids and residual fluids that have not yet been mobilised, i.e. the displacement fronts, are stabilised by gravity, as lighter fluids such as the combustion gases flow vertically upward and the heavier fluids (oil and water) drain downward along the displacement front. The processes of the invention may accordingly be controlled so that displacement fronts move downwardly in the reservoir over time, avoiding gravity override.

Figure 6A:
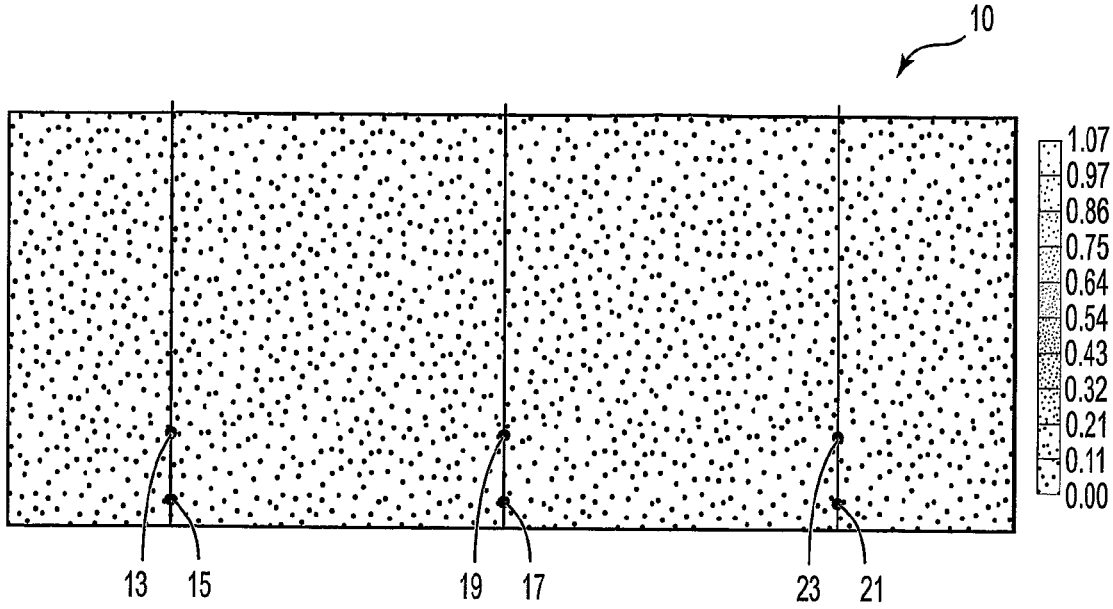
FIGS. 6*a* to 6*d* illustrate, in the same wells and model described above, the gas mole fraction of oxygen (a) after injection and (B through D) at time points during an in situ combustion processes of the invention.
Figure 6B:
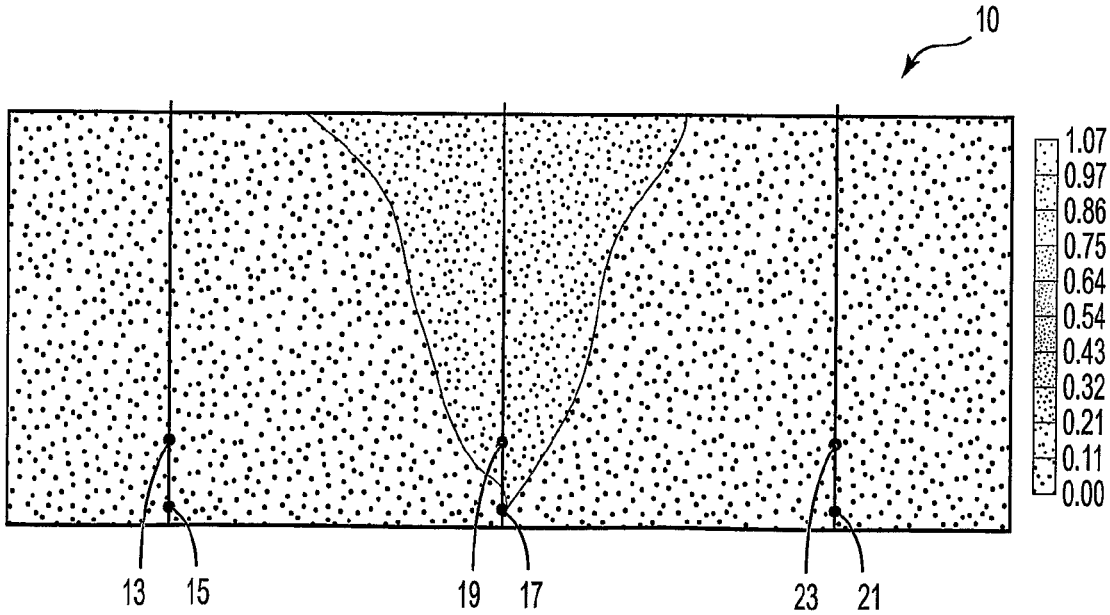
Figure 6C:
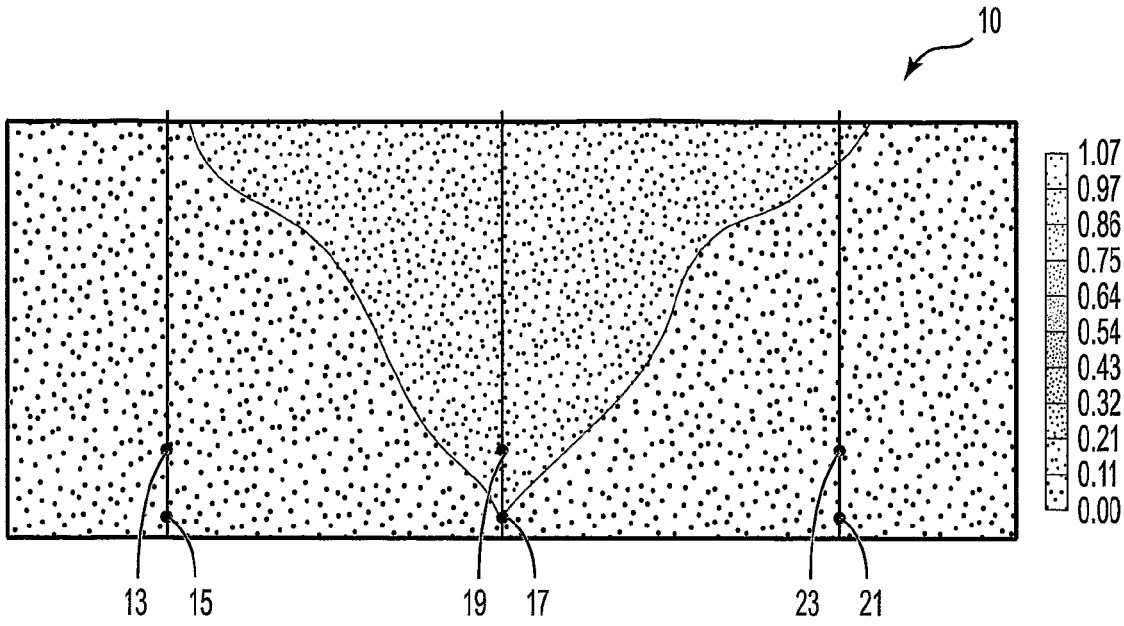
Figure 6D:
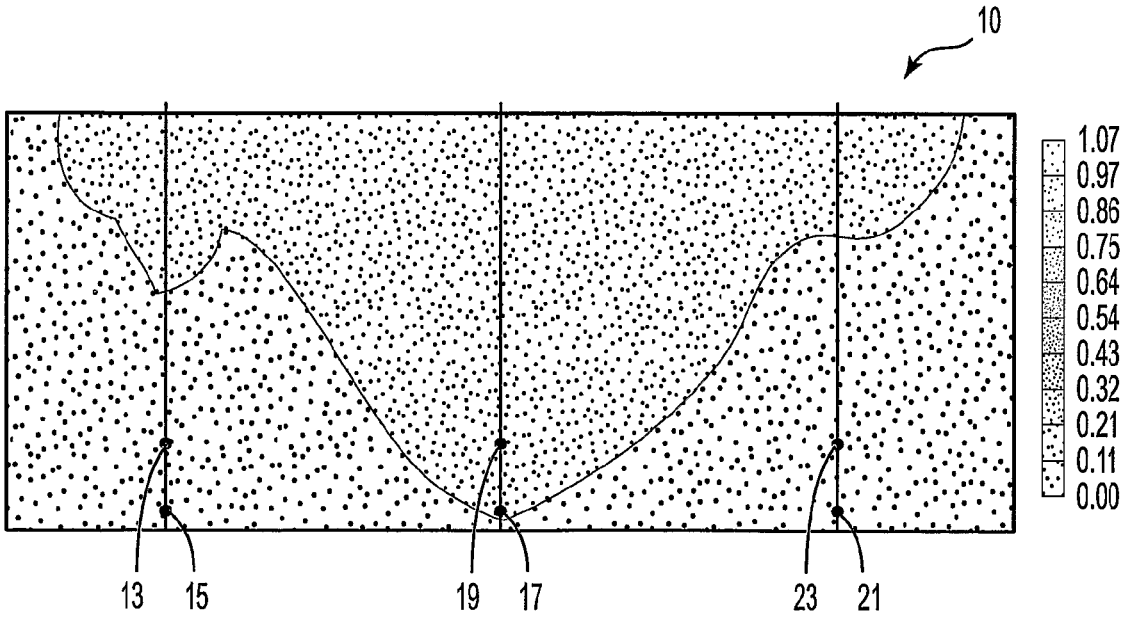

In particular embodiments, the hydrocarbon recovery process may include the step of gradually diluting the oxygen content of the injected oxidising gas. For example, the oxidising gas may be diluted from the approximately 20.9% found in air, in one or more dilution steps, for example until the injection stream contains no oxygen. The oxygen dilution may be undertaken while maintaining the total volume of injected fluid, or adjusting the volume of injected fluid, so that the rate of fluid flux at the combustion front is maintained, i.e. it is not significantly affected by the oxygen dilution. This modification of the oxidising gas injection profile may be made at a relatively mature stage of the in situ combustion operation. In some embodiments, the timing of an oxygen dilution step may be determined by conducting a numerical simulation using representative elements of the reservoir. In some embodiments, oxygen dilution may be implemented at a time that generally corresponds to the arrival of the combustion front at the top of the reservoir, and just before significant displacement of the combustion front into the adjoining mobile zone chambers. The oxygen dilution step may for example be carried out so as to displace a volume of unused oxygen which occupies the space above the oxygen gas injection well (as shown in FIG. 6D), so that the unused oxygen is moved or displaced upwardly to be consumed in the combustion reaction at the combustion front.

Oxygen dilution may for example be accomplished by recycling some of the combustion gases produced from the combustion gas production well, or by introducing other gases such as nitrogen, and carbon dioxide or mixtures thereof at the oxidising gas injection well. Accordingly, the invention may include the step of recycling of combustion gases from the combustion gas production well to the oxidising gas injection well, which may avoid the requirement for disposal of the combustion gases (which may include undesirable components such as hydrogen sulphide and carbon dioxide). Oxygen dilution may also be undertaken to facilitate relaxation of the operating constraints at the hydrocarbon production well situated below the oxygen gas injection well, i.e. facilitating increased production at this hydrocarbon production well while avoiding the risk of producing combustion gases.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

EXAMPLE

Processes of the invention have been modeled in a computer simulation, based on a selected location (CL). Various aspects of the performance of the processes of the invention in the simulation are illustrated in FIGS. 1 to 8. The simulation modeled interactions between injected air, combustion gases and hydrocarbons within the reservoir. The model tracked the behaviour of seven components: heavy oil/bitumen, water, methane, carbon dioxide, nitrogen/carbon monoxide, oxygen and coke.

Figure 3A:
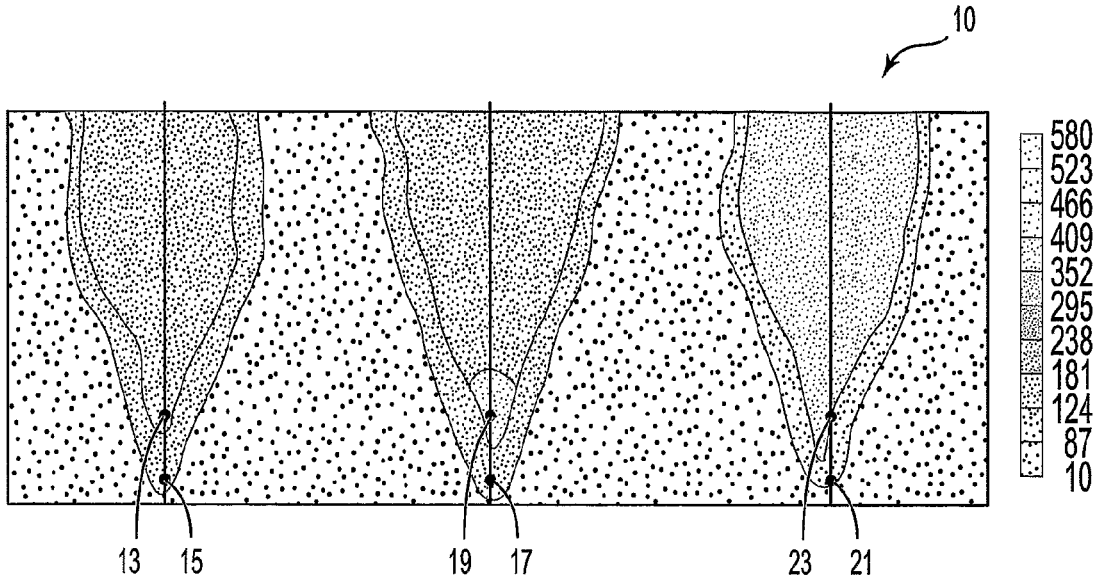
FIGS. 3A to 3D illustrate temperature profiles over time in the same three well pair pattern as is described in FIG. 2.
Figure 3B:
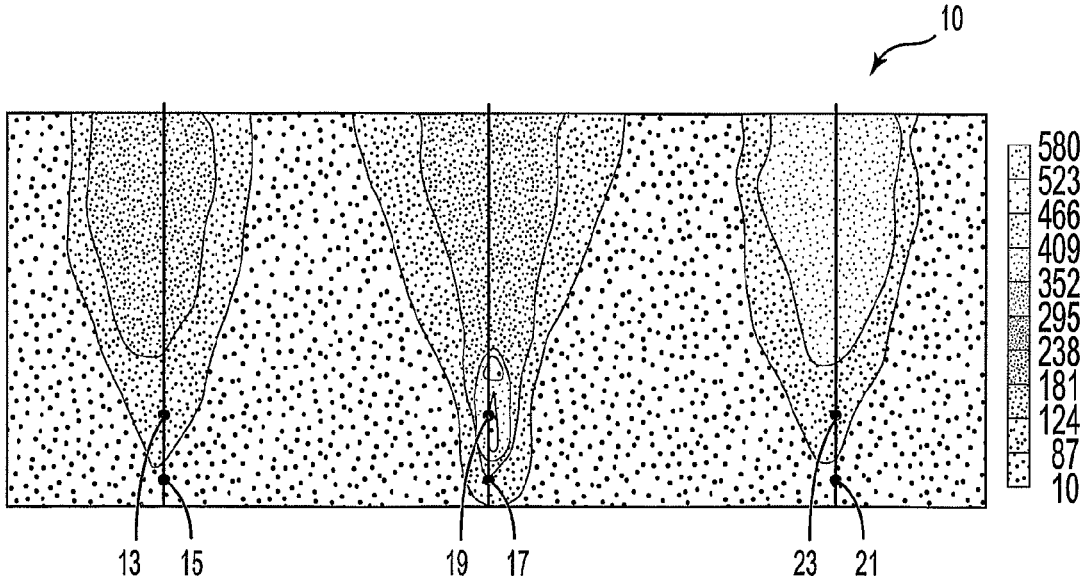
Figure 3C:
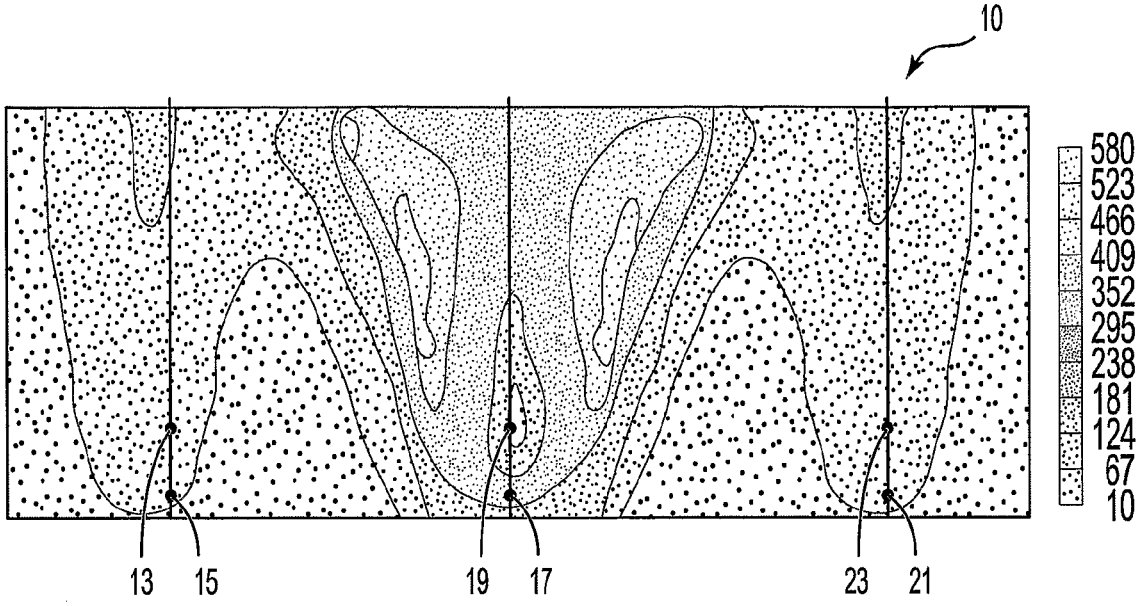
Figure 3D:
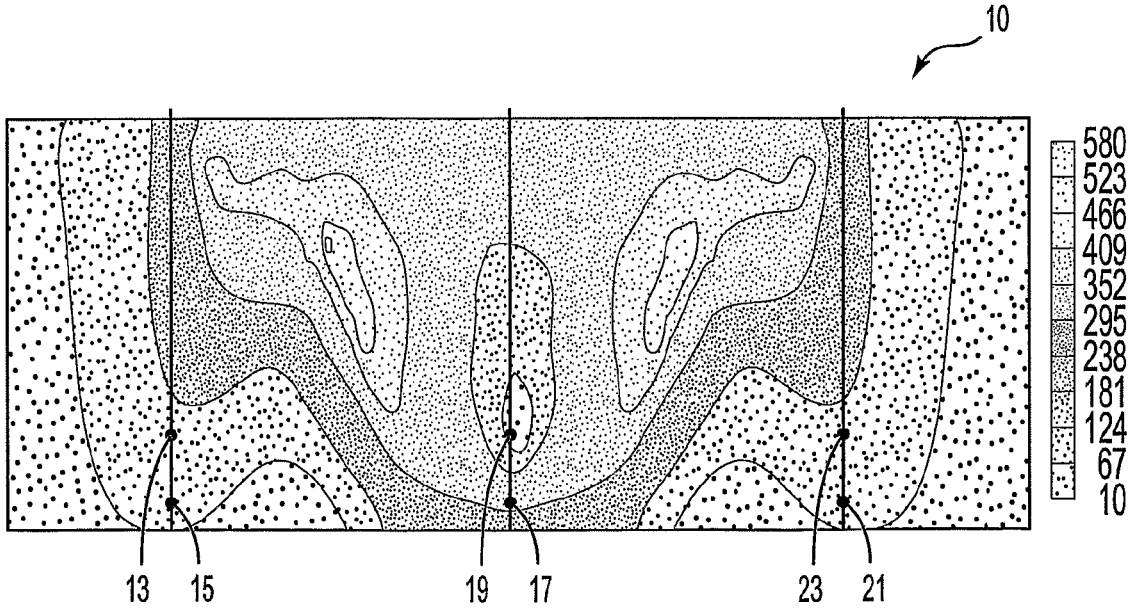

FIGS. 3A to 3D illustrate a time series of temperature profiles in the modeled reservoir during recovery by in situ combustion processes of the invention. FIG. 3B shows ignition and initiation of combustion at the injection well of the central reservoir. FIGS. 3C and 3D show the combustion front rising from the central oxidizing gas injection well toward the top of the central reservoir chamber, and spreading laterally into adjacent reservoir chambers. In some embodiments, the invention accordingly provides processes in which a combustion front migrates from a first chamber in fluid communication with an oxidizing gas injection well towards one or more adjacent secondary chambers that are in fluid communication with combustion gas production wells, the production wells being, in some embodiments, generally parallel to and horizontally spaced apart laterally from the horizontal segment of the oxidizing gas injection well. In some embodiments, the process may be carried out so as to merge the first and secondary chambers by establishing fluid communication between the oxidizing gas injection well and one or more combustion gas production wells.

Figure 4A:
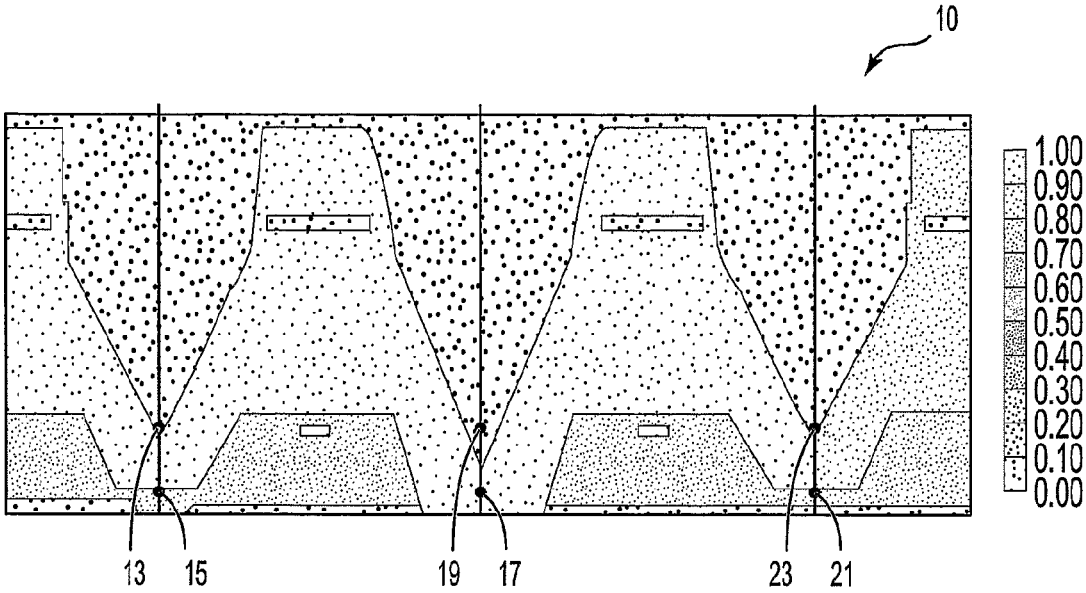
FIGS. 4A to 4D illustrate, in the wells described above, the oil saturation profiles (red) at the time of termination of SAGD operation (4A) and at time points during secondary in situ combustion processes of the invention (4B through 4D).
Figure 4B:
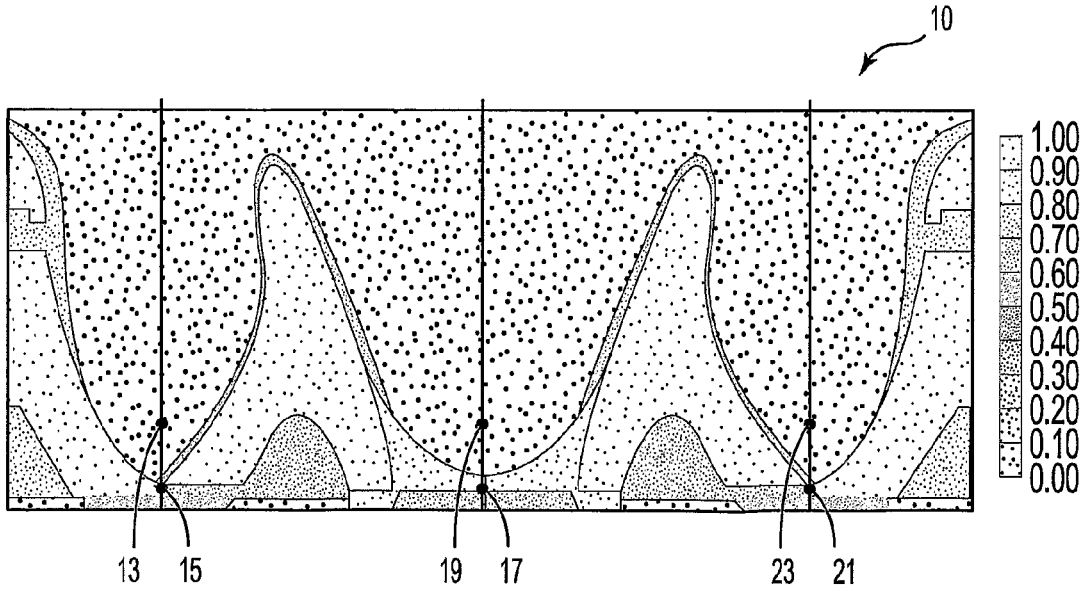
Figure 4C:
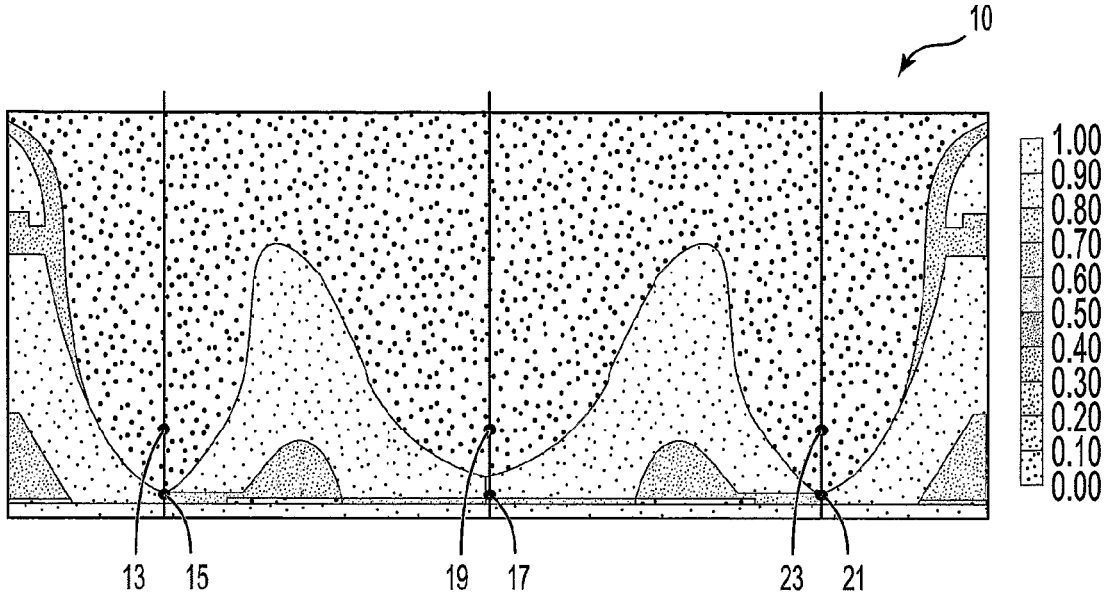
Figure 4D:
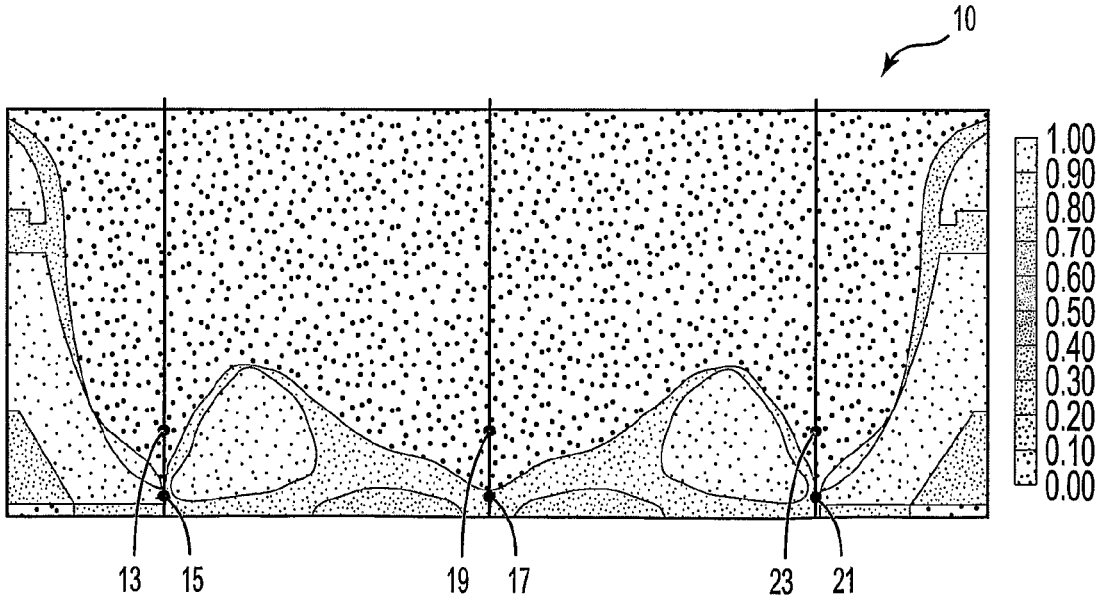

FIGS. 4A to 4D illustrate a time series of oil saturation profiles in the modeled reservoir before and during hydrocarbon recovery by in situ combustion processes of the invention. The oil saturation in FIG. 4A is concentrated in regions between and towards the bottom of the adjacent chambers within the reservoir. FIGS. 4B to 4D illustrate that the oil saturation in these regions diminishes as the secondary in situ combustion process evolves. Accordingly, in some embodiments the invention provides processes for depleting hydrocarbons, including residual hydrocarbons left in place by a previous recovery process, in regions between adjacent well pairs, or between adjacent mobile zone chambers. In such embodiments, the first well pair includes an oxidizing gas injection well and an adjacent well pair includes a combustion gas production well, each of the well pairs also including an underlying hydrocarbon production well. Each of the mobile zone chambers in the reservoir is in fluid communication with a well pair that lies at the base of the chamber.

Figure 5A:
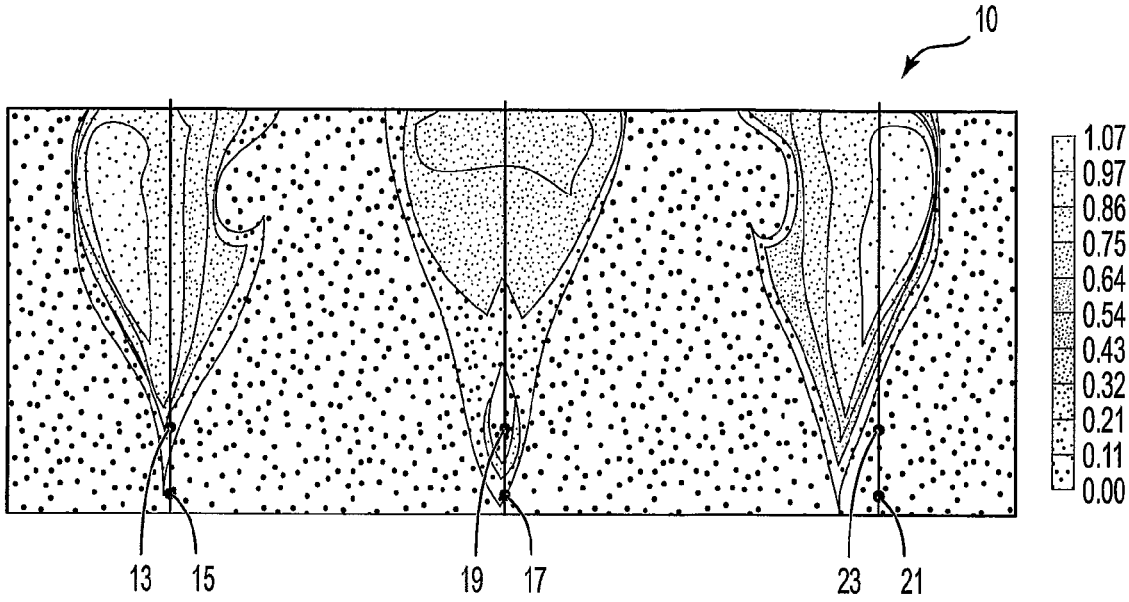
FIGS. 5A to 5D illustrate, in the same wells described above, the gas mole fraction for the water phase, which is indicative of steam saturation distribution, at the termination of SAGD operation (5A) and at time points during a follow up in situ combustion process of the invention (5B through D).
Figure 5B:
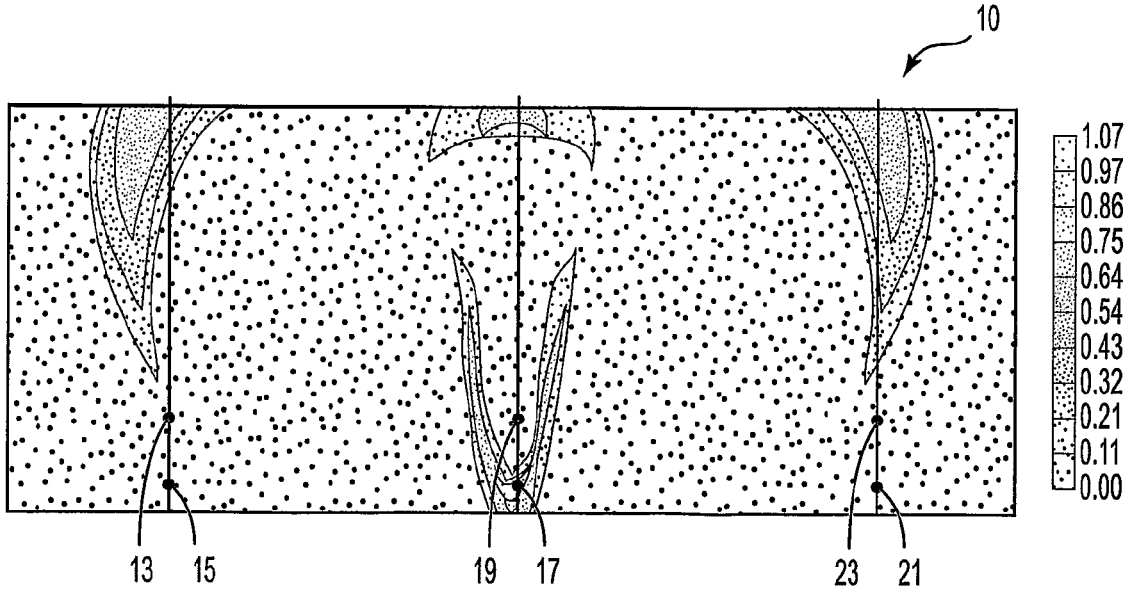
Figure 5C:
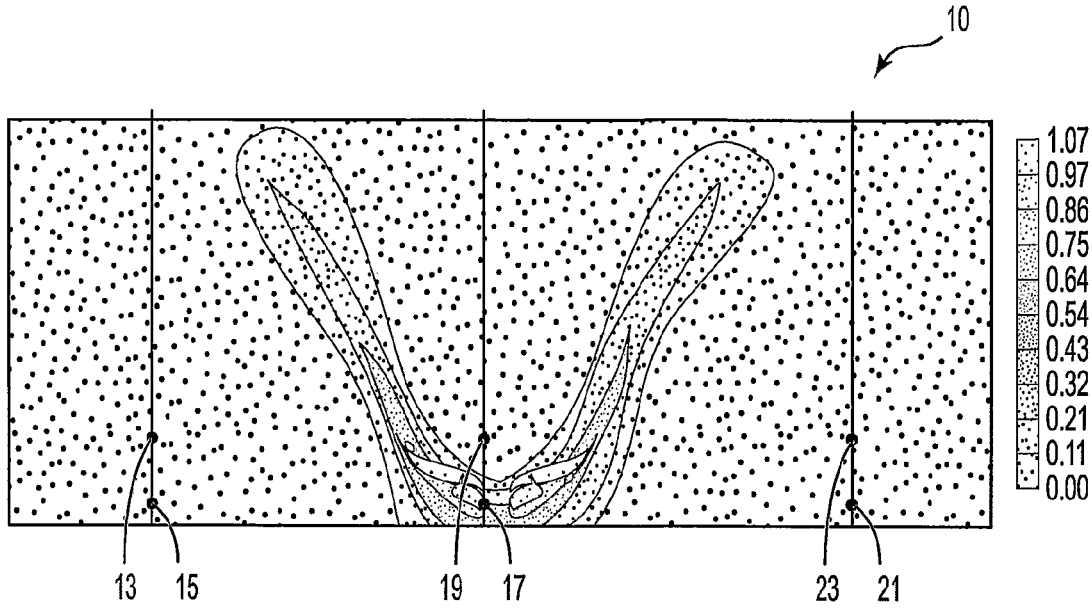
Figure 5D:
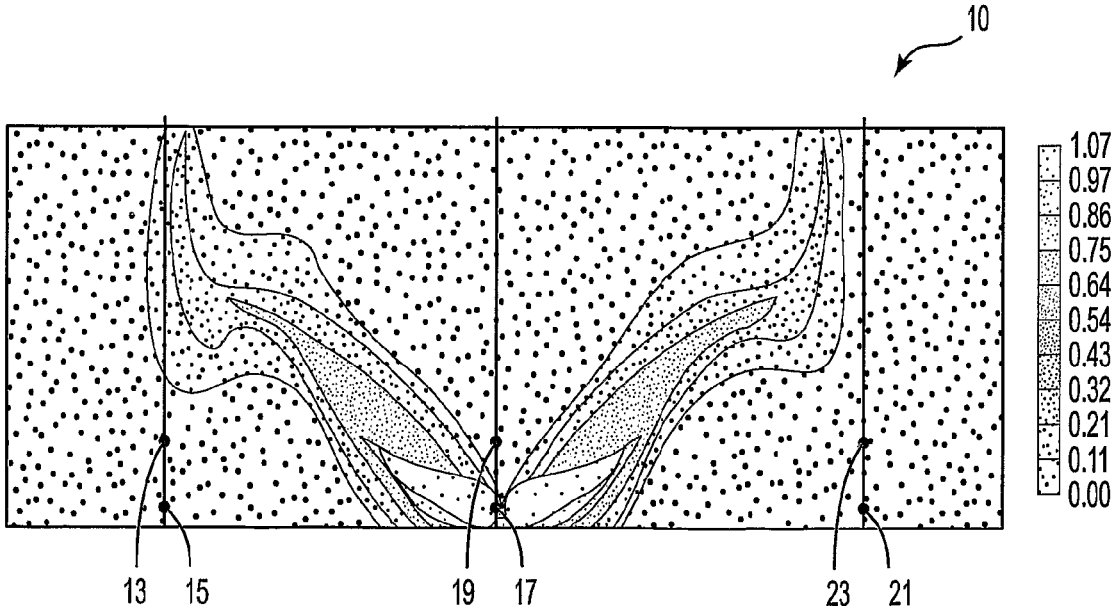

FIGS. 5A to 5D illustrate a time series of water phase distributions within the modeled reservoir, providing an indication of the evolving steam saturation distribution during hydrocarbon recovery by in situ combustion processes of the invention. FIG. 5A shows a putative distribution of steam saturation at the termination of a recovery process such as SAGD. FIGS. 5B through 5D show the progression of a steam bank at time points during a follow up in situ combustion process of the invention. FIG. 5B shows steam distribution following the initiation of air injection and combustion at the oxidizing gas injector well of a central well pair. FIG. 5C shows steam distribution as in situ combustion reactions generate heat to enhance steam bank growth. FIG. 5D illustrates enhanced steam bank distribution, showing heat transfer to residual hydrocarbons to mobilize remaining heavy oil. Accordingly, in some aspects the invention provides processes for sustaining the migration of a steam bank in a reservoir by in situ combustion of residual oil, so that the steam bank migrates from a first chamber in fluid communication with an oxidizing gas injection well towards one or more adjacent secondary chambers that are in fluid communication with combustion gas production wells. The production wells being, in some embodiments, generally parallel to and horizontally spaced apart laterally from the horizontal segment of the oxidizing gas injection well. In some embodiments, the process may be carried out so that the steam bank migrates so as to merge the first and secondary chambers by establishing fluid communication between the oxidizing gas injection well and one or more combustion gas production wells.

FIGS. 6A to 6D illustrate a time series showing the distribution of the gas mole fraction of oxygen in the modeled reservoir during in situ combustion processes of the invention. The continued spread of oxygen over time is indicative of the growth of the zone or chamber swept by the combustion front, as the combustion front migrates from the central chamber into adjacent chambers. In some embodiments, the process may be terminated prior to the breakthrough of significant quantities of unused oxidizing gas into the combustion gas production well. Alternatively, the process may be discontinued when breakthrough of oxidizing gas into the combustion gas production well is detected. Accordingly, in some aspects the invention provides processes for sustaining the migration of a combustion front in a reservoir by in situ combustion of residual oil, so that the combustion front migrates from a first chamber in fluid communication with an oxidizing gas injection well towards one or more adjacent secondary chambers that are in fluid communication with combustion gas production wells.

Figure 7:
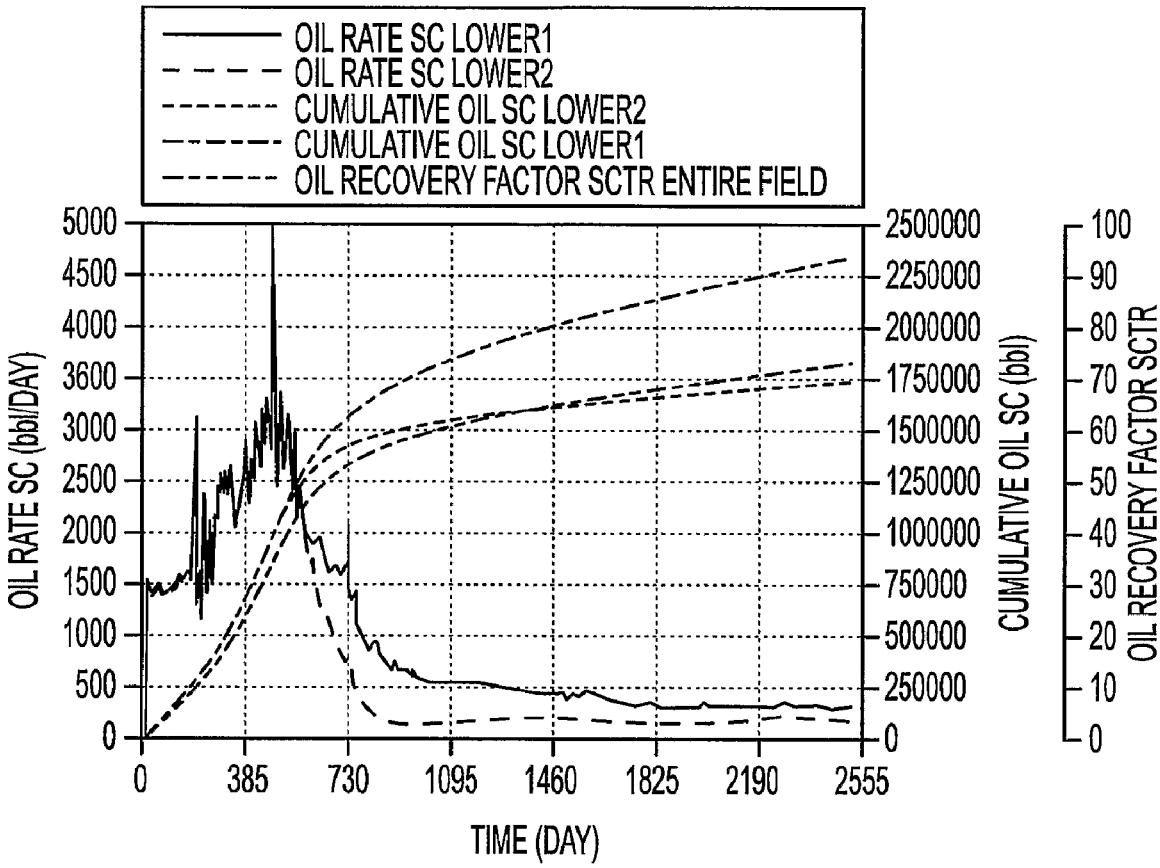
FIG. 7 is a graph showing incremental hydrocarbon (oil) recovery due to oxidizing gas injection in support of in situ combustion, using a well pattern comprised of two well pairs.

FIG. 7 shows the putative incremental hydrocarbon recovery over time in the modeled reservoir, up to 730 days following the initiation of recovery by in situ combustion processes of the invention. The modeled recovery pattern shown in FIG. 7 is for an embodiment containing two well pairs, and may or may not be indicative of results that would be achieved in practice. FIG. 7 is illustrative of an aspect of the invention that includes the recovery of residual hydrocarbons from a heavy oil reservoir following an earlier recovery process. For example, the residual hydrocarbons may be recovered from a region between well pairs used for a previous petroleum recovery process, or between mobile zone chambers that have been subject to hydrocarbon depletion in a previous petroleum recovery process.

Figure 8:
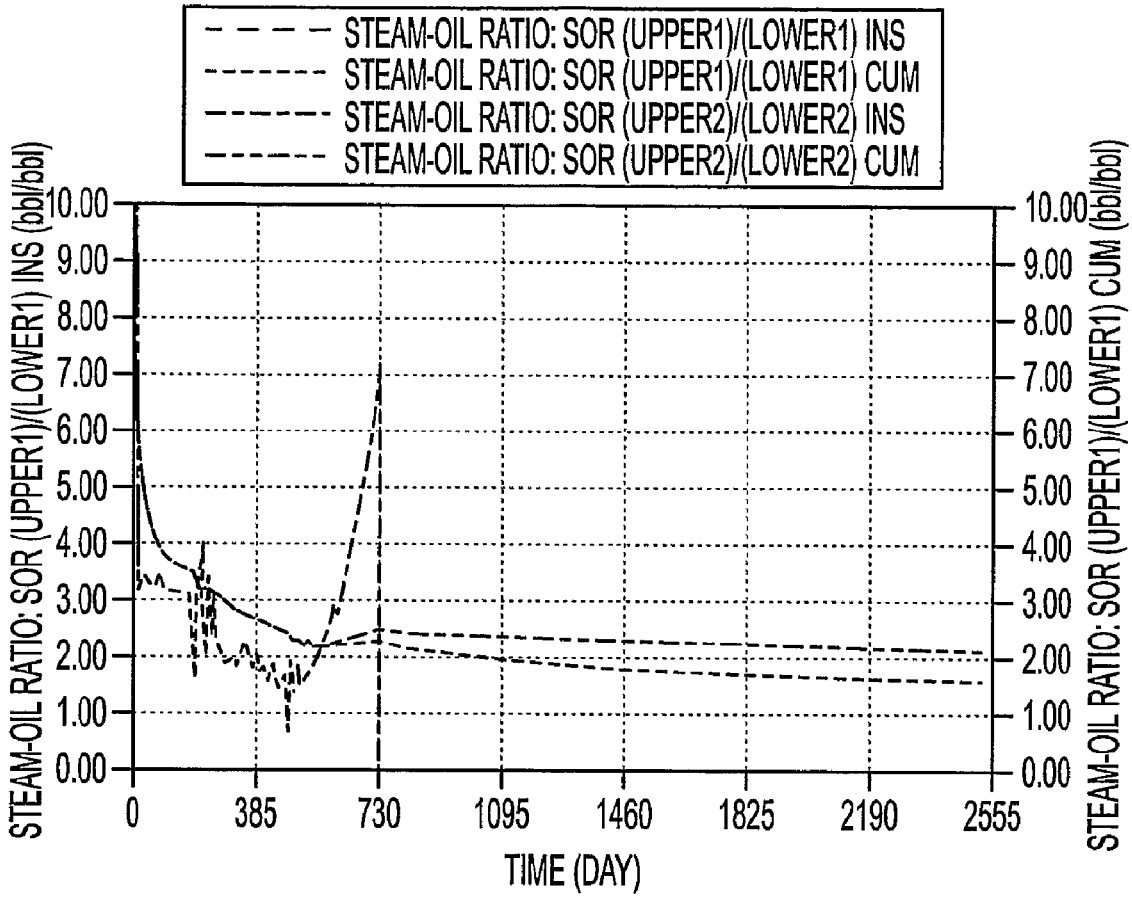
FIG. 8 is a graph showing the cumulative steam-oil ratio from day 730. The reduction in cumulative steam-oil-ratio is one measure of success in evaluation of thermal-based recovery operations, and demonstrates an aspect of the effectiveness of the combustion process of the invention.

FIG. 8 is a graph showing the putative reduction in the cumulative steam-oil production ratio over time, from day 730, in the modeled reservoir. This illustrates an aspect of the invention that involves carrying out an in situ combustion process of the invention so that the cumulative steam-oil production ratio is reduced over time.

We claim:

1. A hydrocarbon recovery process comprising:

a) selecting a hydrocarbon reservoir bearing a heavy oil, the reservoir being in fluid communication with:

i) a generally horizontal segment of a hydrocarbon production well;

ii) a generally horizontal segment of an oxidizing gas injection well, generally parallel to and vertically spaced apart above the horizontal segment of the hydrocarbon production well, the average distance between the horizontal segments of the oxidizing gas injection well and the hydrocarbon production well providing a hydrocarbon production well offset distance; and, iii) a generally horizontal segment of a combustion gas production well, generally parallel to and horizontally spaced apart laterally from the horizontal segment of the oxidizing gas injection well, the average distance between the horizontal segments of the oxidizing gas injection well and the combustion gas production well providing a combustion gas production well offset distance, wherein the combustion gas production well offset distance is greater than the hydrocarbon production well offset distance;

b) injecting an oxidizing gas into the formation through the injection well to support in situ combustion in the formation, to mobilize hydrocarbons in the heavy oil;

c) producing fluids from the combustion gas production well, to direct combustion gases to the combustion gas production well; and, d) recovering the mobilized hydrocarbons from the reservoir through the hydrocarbon production well.

2. The process of claim 1 wherein, prior to the hydrocarbon recovery process, the reservoir, or a portion thereof, has undergone depletion of petroleum in a petroleum recovery process, leaving a residual oil deposit in the reservoir.

3. The process of claim 2, wherein the petroleum recovery process comprises producing the petroleum from the hydrocarbon production well.

4. The process of claim 3 wherein the petroleum recovery processes comprises injecting a mobilizing fluid into the injection well to mobilize the petroleum that is produced from the hydrocarbon production well.

5. The process of claim 4 wherein gravity provides a force that acts to direct the mobilized petroleum downward to hydrocarbon production well.

6. The process of claim 4, wherein the mobilizing fluid is selected from the group consisting of steam, hot water and hydrocarbon solvents.

7. The process of claim 1, further comprising:

initiating the in situ combustion in the hydrocarbon recovery process.

8. The process of claim 7, wherein the oxidizing gas is air.

9. The process of claim 7, further comprising:

controlling in situ combustion by injecting an aqueous fluid through the injection well.

10. The process of claim 1, which process further includes a generally horizontal segment of a second hydrocarbon production well, generally parallel to and vertically spaced apart below the horizontal segment of the combustion gas production well, the average distance between the horizontal segments of the second hydrocarbon production well and the combustion gas production well providing a second hydrocarbon production well offset distance, wherein the combustion gas production well offset distance is greater than the second hydrocarbon production well offset distance, and wherein mobilized hydrocarbons are recovered from both the hydrocarbon production well and the second hydrocarbon production well.

11. The process of claim 10, wherein the oxidizing gas injection well and the hydrocarbon production well form a first well pair, and the combustion gas production well and the second hydrocarbon production well form a second well pair, the second well pair being spaced apart laterally from the first well pair by the combustion gas production well offset distance.

12. The process of claim 11, wherein the petroleum recovery process forms a first mobile zone chamber above and in fluid communication with the first well pair.

13. The process of claim 12, wherein the petroleum recovery process forms a secondary mobile zone chamber above and in fluid communication with the second well pair.

14. The process of claim 13, wherein the hydrocarbon recovery process is carried out so as to merge the first mobile zone chamber and the secondary mobile zone chamber by establishing fluid communication between the oxidizing gas injection well and the combustion gas production well.

15. The process of claim 14, wherein the hydrocarbon recovery process is carried out so as to recover a portion of the residual oil from a region between the first mobile zone chamber and the secondary mobile zone chamber.

16. The process of claim 13, wherein the hydrocarbon recovery process is carried out so as to sustain the migration of a steam bank by in situ combustion of the residual oil, so that the steam bank migrates from the first mobile zone chamber towards the secondary mobile zone chamber.

17. The process of claim 13, wherein the hydrocarbon recovery process is carried out so as to sustain the migration of a combustion front in the reservoir by in situ combustion of the residual oil, so that the combustion front migrates from the first mobile zone chamber towards the secondary mobile chamber.

18. The process of claim 1 wherein the reservoir comprises sand or sandstone strata.

19. The process of claim 1 wherein the reservoir comprises carbonate materials.

20. A hydrocarbon recovery process, comprising:

a) selecting a hydrocarbon reservoir bearing a heavy oil, the reservoir being in fluid communication with:

i) a generally horizontal segment of a hydrocarbon production well;

ii) a generally horizontal segment of an oxidizing gas injection well, generally parallel to and vertically spaced apart above the horizontal segment of the hydrocarbon production well, the average distance between the horizontal segments of the oxidizing gas injection well and the hydrocarbon production well providing a hydrocarbon production well offset distance; and, iii) a generally horizontal segment of a combustion gas production well, generally parallel to and horizontally spaced apart laterally from the horizontal segment of the oxidizing gas injection well, the average distance between the horizontal segments of the oxidizing gas injection well and the combustion gas production well providing a combustion gas production well offset distance, wherein the combustion gas production well offset distance is greater than the hydrocarbon production well offset distance;

b) injecting air into the formation through the injection well of a reservoir that has undergone depletion of petroleum recovery process, leaving a residual oil deposit in the injection carried out to support in situ combustion in the formation;

c) initiating combustion;

d) producing fluids from the combustion gas production well, to direct combustion gases to the combustion gas production well; and e) producing petroleum from the hydrocarbon production well.

* * * * *